US005758715A

United States Patent [19]

Kurokawa et al.

[11] Patent Number: 5,758,715

[45] Date of Patent: Jun. 2, 1998

[54] METHOD OF MANUFACTURING A WIDE METAL THIN STRIP

[75] Inventors: Katsumi Kurokawa; Shun Suhara; Toshitane Matsukawa; Haruhiko Ishizuka; Toru Sato, all of Chiba, Japan

[73] Assignee: Kawsaki Steel Corporation, Kobe, Japan

[21] Appl. No.: 717,907

[22] Filed: Sep. 23, 1996

[30] Foreign Application Priority Data

Sep. 29, 1995 [JP] Japan ..... 7-253231
Sep. 29, 1995 [JP] Japan ..... 7-253232

[51] Int. Cl.[6] ..... B22D 11/06; B22D 11/10

[52] U.S. Cl. ..... 164/463; 164/423

[58] Field of Search ..... 164/463, 423, 164/479, 429

[56] References Cited

U.S. PATENT DOCUMENTS

| | | |
|---|---|---|
| 4,142,571 | 3/1979 | Narasimhan . |
| 4,221,257 | 9/1980 | Narasimhan . |
| 4,331,739 | 5/1982 | Narasimhan . |

FOREIGN PATENT DOCUMENTS

| | | |
|---|---|---|
| 57-103761 A | 6/1982 | Japan . |
| 57-103763 A | 6/1982 | Japan . |
| 58-132357 A | 8/1983 | Japan . |
| 62-166056 A | 7/1987 | Japan . |
| 63-220950 A | 9/1988 | Japan . |
| 1-170554 A | 7/1989 | Japan . |

*Primary Examiner*—Kuang Y. Lin
*Attorney, Agent, or Firm*—Oliff & Berridge

[57] ABSTRACT

In a method of manufacturing a wide metal thin strip, molten metal is ejected onto the surface of a rotating cooling roll. The nozzle shape permits manufacture of wide metal thin strips having a uniform thickness in the width direction.

9 Claims, 8 Drawing Sheets

METHOD OF MANUFACTURING A WIDE METAL THIN STRIP

BACKGROUND OF THE INVENTION

1. Field of the Invention

The present invention relates to a method of manufacturing a wide metal thin strip through rapid cooling of a molten metal on the surface of a cooling roll which rotates at high speeds, causing solidification of the molten metal.

2. Description of the Related Art

Various methods have been proposed for manufacturing a metal thin strip (hereinafter "thin strip") from molten metal. Particularly for the manufacture of a wide thin strip, a method known as the planar-flow-casting process is believed to be advantageous. More specifically, as showing in FIG. 1, this method comprises arranging a nozzle having a slit-shaped opening, provided on the bottom of a molten metal vessel 2 in the vicinity of a cooling roll 1 which rotates at high speeds. Molten metal is ejected from an opening 3 of the nozzle onto the surface of the cooling roll 1. The molten metal rapidly cools on the cooling roll, causing it to solidify and form a thin strip 4. Important operational factors in this technique include the distance between the nozzle and the roll, the peripheral speed of the roll, the ejecting pressure of the molten metal and the gap of the slit-shaped opening of the nozzle.

Japanese Unexamined Patent Publication No. 53-53525 discloses a similar method of continuously manufacturing a metal strip, which comprises providing a slotted nozzle having a rectangular opening in a position opposite to a moving cooling plate with a distance of from 0.03 to 1 mm in between. Molten metal is fed onto the cooling plate which moves at a prescribed speed, within a range of 100 to 2,000 m/minute, in a state in which an orifice of the nozzle is arranged substantially vertical to the surface of the cooling plate. The molten metal is rapidly cooled by bringing the molten metal into thermal contact to cause solidification. By this method, the shape of the rectangular opening of the nozzle can be made longer in a direction at right angles to the moving direction of the cooling plate, and hence, the width of the thin strip can be made larger, because, in theory, there is no restriction on the width of the thin strip.

However, in actual practice, as the width of the thin strip to be manufactured becomes larger, i.e., as the length of the rectangular opening becomes longer, deformation of the nozzle opening caused by thermal stress or ejecting pressure becomes problematic. It becomes difficult to maintain the parallelism of the nozzle opening gap during casting.

In view of this problem, Japanese Unexamined Patent Publication No. 58-132357 discloses prevention of nozzle deformation by providing a weir in the interior of the nozzle slit. The disclosure suggests that it is possible to manufacture a thin strip with a width of 150 mm, having a uniform thickness in the width direction.

Japanese Unexamined Patent Publication No. 63-220950 and Japanese Unexamined Patent Publication No. 1-170554 disclose a method of manufacturing a thin strip by means of a nozzle having a discontinuous opening in the width direction of the strip, in place of a rectangularly slotted nozzle. By this method, it is possible to manufacture a thin strip having a uniform thickness in the width direction by specifying the shape and arrangement of the opening. In theory, it is possible to increase the width of the thin strip without limitation.

This method poses problems in industrial applications because the nozzle has a complicated shape, which results in high processing costs. Furthermore, a deviation of the thin strip thickness in the width direction is caused by not only the slit deformation but by disturbance of the molten metal flow or non-uniform solidification under the effect of: (1) thermal deformation of the roll and the nozzle; (2) temperature of the roll, molten metal and the nozzle; (3) the puddle length due to surface tension of the molten metal; and (4) non-uniformity of the air flow produced by the roll rotation in the width direction of the thin strip. Therefore, thickness deviations in the width direction cannot be completely prevented by prevention of slit deformation alone.

Under these circumstances, the present inventors carried out a casting experiment using a nozzle having an opening as shown in FIG. 2, with the goal of achieving uniform thin strip thickness by preventing deformation of the nozzle opening. The resultant thin strip displayed a thickness profile, as shown in FIG. 3, similar to that available when using a conventional nozzle having a rectangular opening. More specifically, the results illustrate the difficulty of achieving uniform thickness in the width direction through only preventing slit deformation. The results also illustrate the necessity of taking comprehensive measures to prevent slit deformation.

In contrast, Japanese Unexamined Patent Publication Nos. 57-103761, 57-103763 and 62-166056 disclose methods and apparatuses for eliminating the deviation of the molten steel flow rate through either varying the slit gap in the longitudinal direction or by longitudinally varying the bore diameter at the opening comprising a row of small holes.

These known techniques only relate to the casting of a thin strip having a maximum width of 20 mm. It is difficult to apply such techniques to the casting of a wide metal thin strip. The known techniques do suggest the possibility of eliminating deviations in the molten steel flow rate by imparting a thickness (or bore diameter) distribution in the width direction of the nozzle. Those disclosures, however, fail to describe a method of controlling the thickness distribution of the thin strip. Therefore, the problem of how to set a longitudinal distribution of the slit gap, when casting a wide metal thin strip with a thickness uniform in the width direction, is left unsolved.

Practical difficulties arise when the thin strip thickness is non-uniform in the width direction. For example, quality problems arise when non-uniform metal strips are utilized as laminates or for coil processing for magnetic materials in transformers. This results in an unstable coiling for transfer during manufacture.

SUMMARY OF THE INVENTION

The present invention provides a method of manufacturing a thin strip with a uniform width thickness which overcomes the problems described above A first embodiment of the invention comprises the steps of ejecting molten metal from the slit-shaped opening of a nozzle toward the surface of a cooling roll. The cooling roll, located in the vicinity of the nozzle, rotates at high speeds. The resultant rapid cooling causes solidification of the molten metal. Upon ejecting the molten metal, the opening plane(s) of the nozzle are longitudinally convex. The gap between the nozzle opening planes and the cooling roll is smaller at the center, in the longitudinal direction of the nozzle opening plane, and becomes larger toward the ends in the longitudinal direction.

As used herein, the term "opening plane" refers to the plane or planes, or curved plane, defined by the opening surfaces of the nozzle, as shown in FIG. 5. In embodiments, the opening planes are comprised of a center plane, which forms a surface parallel to the cooling roll, and two planes extending from the edges of the center plane which taper away from the cooling roll.

A second embodiment comprises the steps of ejecting molten metal from the slit-shaped opening of a nozzle toward the surface of the cooling roll. The cooling roll rotates at high speeds. The resultant rapid cooling of the molten metal causes solidification. Upon ejection of the molten metal, the gap between the nozzle opening plane and the cooling roll is such that the longitudinal distribution is expressed by the following equation (1):

$$g(x)=g_o\cdot[[\{-4(t_{ce}-t_{ed})/L^2]\cdot x^2+t_{ce}]+t_{ce}\}^{(-1/n)} \quad (1)$$

where,

- g(x): the gap (mm) between the nozzle opening plane and the cooling roll at a distance of x (mm) from the longitudinal center of the nozzle opening plane;
- $g_o$: the gap (mm) between the nozzle opening plane and the cooling roll at the longitudinal center of the nozzle opening plane;
- $t_{ce}$: the thickness (μm) at the width center of a metal thin strip manufactured with a constant longitudinal gap $g_o$ between the nozzle opening plane and the cooling roll;
- $t_{ed}$: the thickness (μm) at the width ends of a metal thin strip manufactured with a constant longitudinal gap $g_o$ between the nozzle opening plane and the cooling roll;
- L: the width (mm) of the metal thin strip to be manufactured; and
- n: an experimentally derived constant representing the degree of effect of the nozzle gap on the thickness: (Thickness)∝(nozzle gap)$^n$.

A third embodiment comprises the steps of ejecting a molten metal from a nozzle having a slit-shaped opening elongated in the axial direction of a cooling roll, toward the surface of the cooling roll The cooling roll is rotating at high speed. The resultant rapid cooling of the molten metal causes solidification. Upon ejection of the molten metal, the nozzle provides a longitudinal distribution which substantially satisfies the following equation (2) with respect to the gap located at right angles to the longitudinal direction of the slit shaped opening:

$$a(x)=a_o\cdot[[\{-4(t_{ce}-t_{ed})/L_2\}\cdot X^2+t_{ce}]/t_{ce}]^{(-1/p)} \quad (2)$$

where,

- a(x): the gap (mm) at a distance of x (mm) from the longitudinal center of the slit-shaped opening;
- $a_o$: the gap (mm) at the longitudinal center of the slit-shaped opening;
- $t_{ce}$: the thickness (μm) at the width center of a metal thin strip manufactured by a nozzle having a rectangular opening, having a gap $a_o$ and a uniform longitudinal length;
- $t_{ed}$: the thickness (μm) at the width ends of a metal thin strip manufactured by a nozzle having a rectangular opening with a gap $a_o$ and a uniform longitudinal length;
- L: the width (mm) of the metal thin strip to be manufactured; and
- p: an experimentally derived constant representing the effect of the slit-shaped opening gap on the thickness: (Thickness)∝(slit gap)$^p$.

The solidified thin strip may be collected by conventional methods, such as with windup rollers or similar devices.

DESCRIPTION OF PREFERRED EMBODIMENTS

Figure 1:
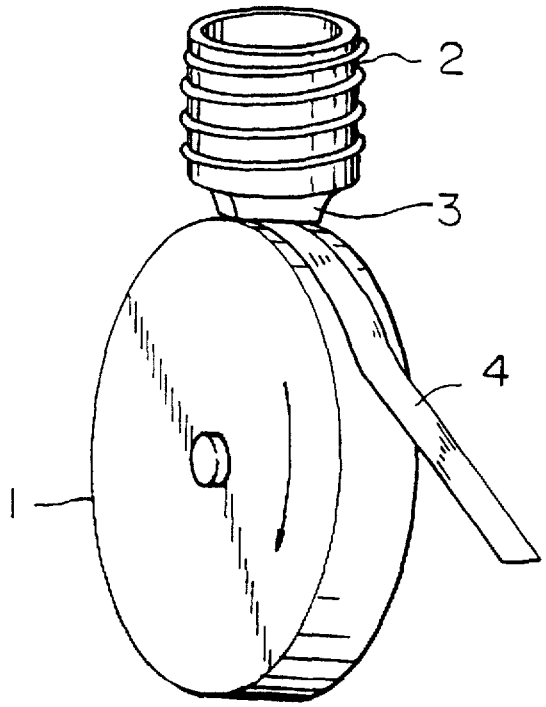
FIG. 1 shows a method of manufacturing a thin strip.
Figure 2:
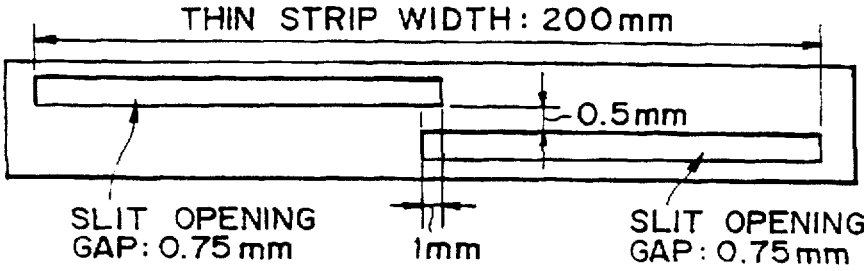
FIG. 2 is a perspective view showing the shape of a nozzle opening according to the conventional art.
Figure 3:
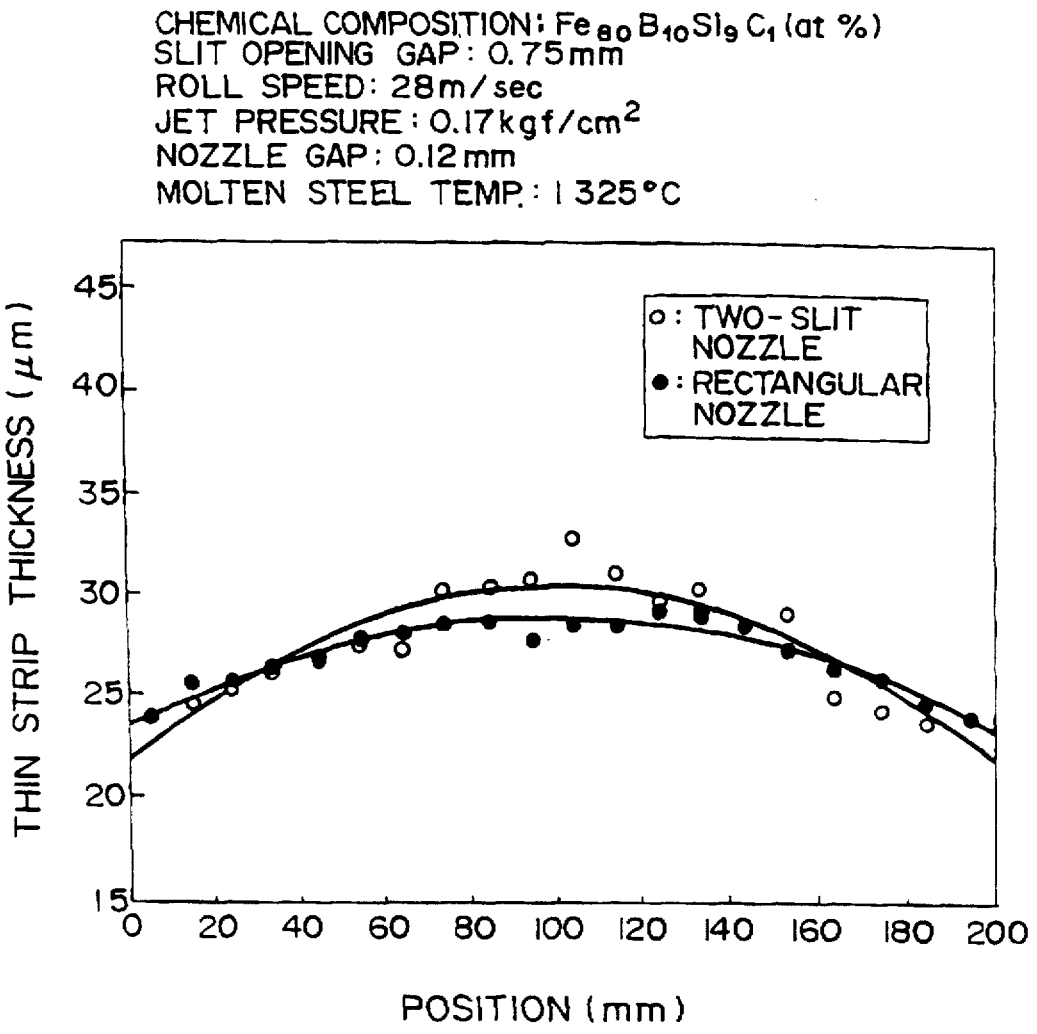
FIG. 3 is a graph illustrating the thickness distribution of a thin strip manufactured by the conventional art.
Figure 4:
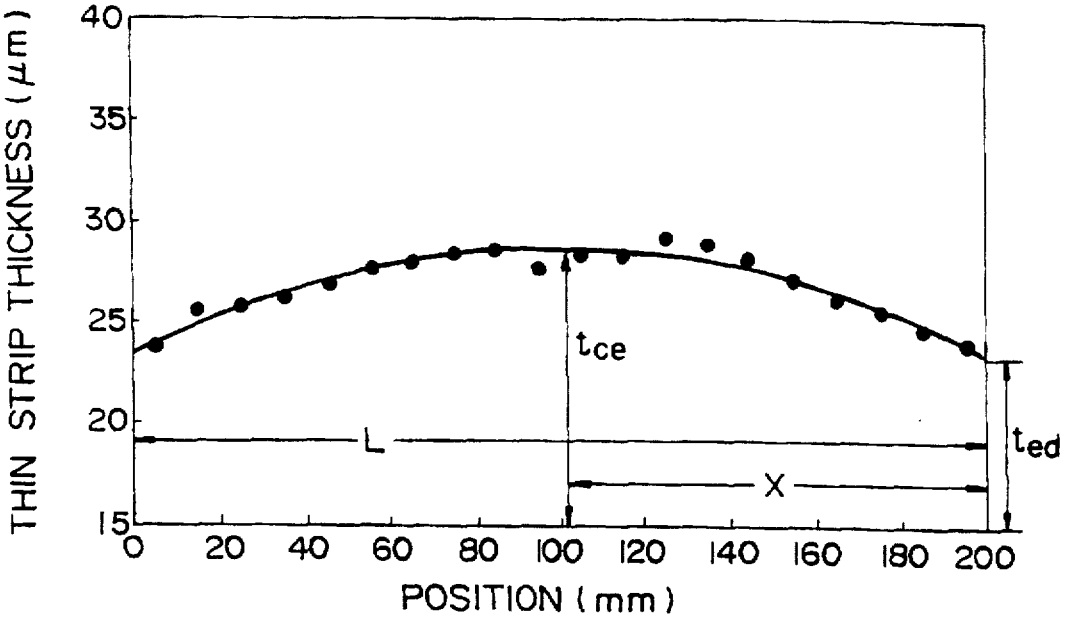
FIG. 4 is a graph illustrating the thickness distribution of a thin strip manufactured by the conventional art.

FIG. 1 illustrates the manufacture of thin strips under various conditions. Thin strips were manufactured under various conditions using nozzles having a rectangular opening and having a width within a range of from 50 to 250 mm. The thickness profiles of the resultant thin strips were investigated. The thickness profiles of the thin strips investigated were found to be mostly of convex parabolic shapes, as illustrated in FIG. 4. The results, shown in FIG. 4, were derived from manufacture of 200 mm-wide thin strip under conditions shown in Table 1.

TABLE 1

| | |
|---|---|
| Molten metal composition | Fe: 80 at %, B: 10 at %, Si: 9 at %, C: 1 at % |
| Molten metal temperature | 1325° C. |
| Slit opening gas | 0.75 mm |
| Roll peripheral speed | 28 m/s |
| Ejecting pressure | 0.17 kgf/cm$^2$ |
| Roll-nozzle gap (nozzle gap) | 0.12 mm |
| Thin strip thickness | Center 28 μm, Edge 24 μm |

Extensive studies were then conducted under similar conditions to develop a method of changing the thickness profile shown in FIG. 4 into a substantially linear thickness profile. This led to embodiments of the present invention. The relationship between the gap between the nozzle opening plane and the cooling roll (hereinafter referred to as the "nozzle gap") and the thin strip thickness (average in the width direction) was considered with reference to a report by Fiedler, et al. in J. Mater. Sci. 19 (1984) 3229. The following relation was derived:

$$(\text{Thickness}) \propto (\text{nozzle gap})^n \ (n \approx 0.25)$$

In this relation, n is a constant dependent on the equipment configuration and operating conditions in the manufacture of a thin strip. A manufacturing experiment was carried out which varied the nozzle gap under the manufacturing conditions shown in Table 1. The experiment resulted in a value of $n \approx 0.25$.

Adjusting the nozzle gap, therefore, is an effective means of controlling the thin strip thickness. Under the thin strip manufacturing conditions shown in FIG. 4, for example, the thickness can be expected to be uniform in the width direction if the nozzle gap is adjusted so that it is smallest at the longitudinal center and becomes larger toward both end portions.

Analysis of thin strips obtained under the various conditions revealed the possibility of approximating the thickness profile by a parabola. For example, the thickness profile of a thin strip shown in FIG. 4 can be expressed by:

$$t(x) = \{-4(t_{ce} - t_{ed})/L^2\} \cdot X^2 + t_{ce} \quad (3)$$

where, t(x): the thickness (mm) at a distance of x (mm) from the width center of the thin strip;

$t_{ce}$: thickness (μm) at the width center of the thin strip;

$t_{ed}$: thickness (μm) at ends in the width direction of the thin strip;

L: width (mm) of the thin strip to be manufactured.

Therefore, under the same conditions except for the nozzle gap, by imparting a longitudinal distribution to the nozzle gap in accordance with the following equation where:

$$g(x) = g_o \cdot (t(x)/t_{ce})^{(-1/n)} = g_o \cdot [[\{-4(t_{ce} - t_{ed})/L^2\} \cdot X^2 + t_{ce}]/t_{ce}]^{(-1/n)} \quad (1)$$

where, g(x): gap (mm) between the nozzle opening plane and the cooling roll at a distance of x (mm) from the longitudinal center of the nozzle opening plane;

$g_o$: gap (mm) between the nozzle opening plane and the cooling roll at the longitudinal center of the nozzle opening plane;

it is possible to achieve a thickness $t_{ce}$ of the thin strip over the entire width. That is, it is possible to manufacture a thin strip having a uniform thickness by providing a longitudinal distribution which satisfies the foregoing equation (1).

For example, for the thin strip shown in FIG. 4, L:200 mm, $t_{ce}$: 28 μm and $t_{ed}$: 24 μm, and the manufacturing conditions include $g_o$: 0.12 mm and $n \approx 0.25$. The thickness in the width direction becomes substantially uniform, with a value of 28 μm, when the longitudinal distribution of the nozzle gap is in accordance with:

$$g(x) = 0.12\ (\text{mm}) \cdot [\{(-1/2500) \cdot X^2 + 28\}/28]^{(-1/0.25)} \quad (4)$$

As compared to the related art described above, it is easier to adjust the nozzle opening plane to provide a longitudinal distribution of the nozzle gap which satisfies the foregoing equation (1). It is necessary, however, to adjust the nozzle opening plane into a curved surface, and this involves some difficulties. On the basis of the technical idea described above, measures taken to facilitate working of the nozzle opening plane are described below.

Figure 5:
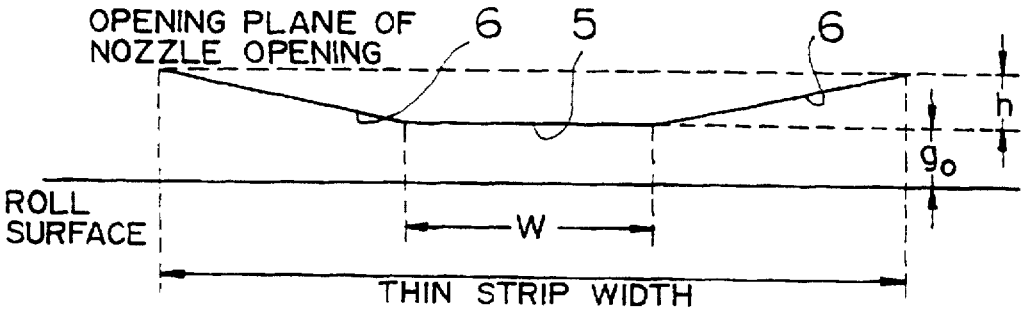
FIG. 5 illustrates a profile of the nozzle opening plane used in the present invention.

More particularly, as shown in FIG. 5, which illustrates a profile of the nozzle opening plane together with the surface of the cooling roll, the longitudinal center, or the vicinity thereof, of the nozzle opening plane should be convex toward the cooling side. The convex shape is preferably formed by a parallel surface 5, which is parallel to the cooling roll surface, and tapered surfaces 6, which extend in a direction more distant from the cooling roll at both sides of the parallel surface 5. This construction permits a longitudinal distribution which substantially satisfies the foregoing equation (1) to the nozzle gap, and hence facilitates the working of the nozzle opening plane.

Figure 6:
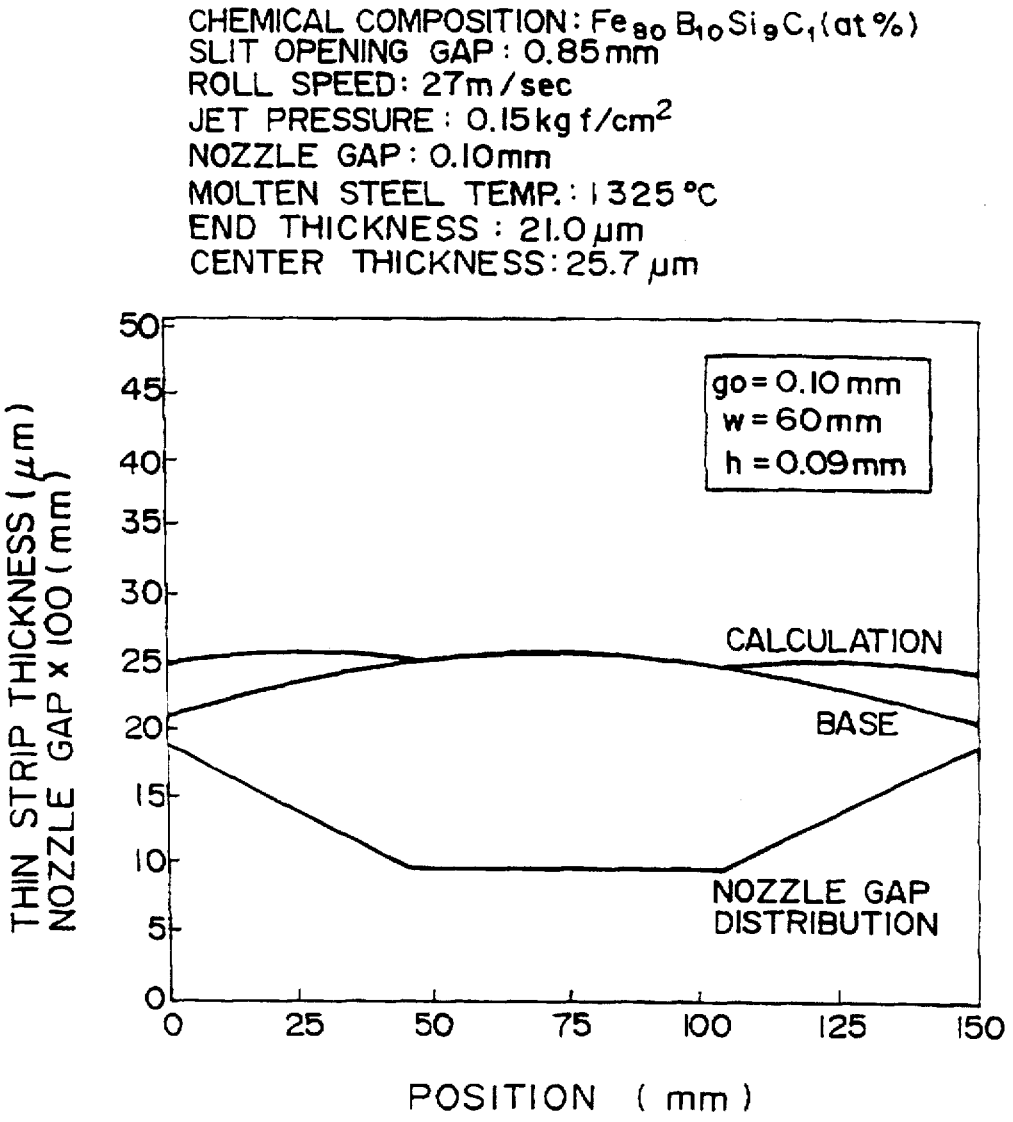
FIG. 6 is a graph illustrating the effect available from control of the nozzle gap according to the present invention.
Figure 7:
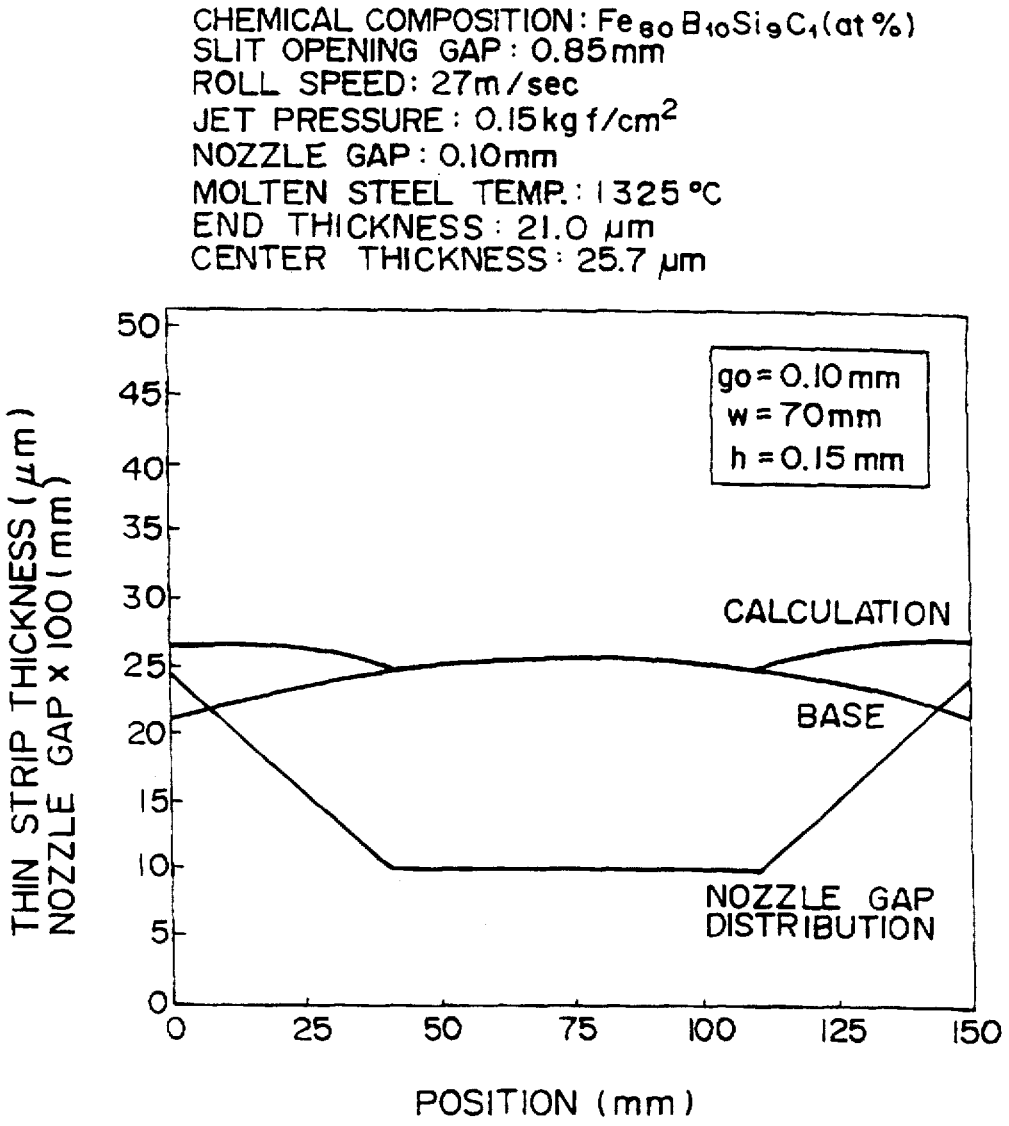
FIG. 7 is a graph further illustrating the effect available from control of the nozzle gap according to the present invention.
Figure 8:
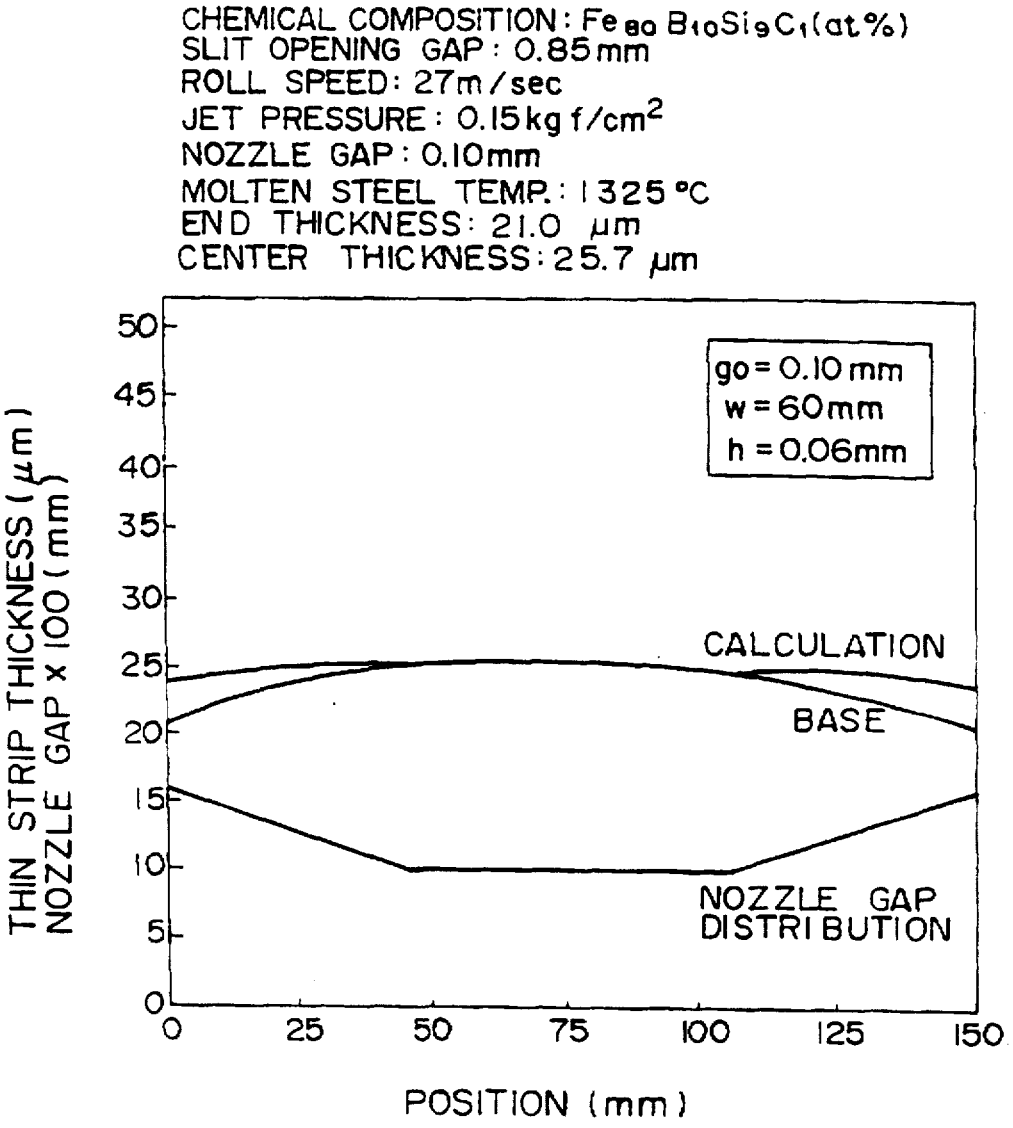
FIG. 8 is a graph further illustrating the effect available from control of the nozzle gap according to the present invention.

For a width w of the parallel surface 5 and the height h of the tapered surfaces 6 at the nozzle opening plane, optimum values can be selected for each of the operating conditions through a simple simulation or the like. FIGS. 6, 7 and 8 illustrate cases of such simulation for the manufacture of a 150 mm-wide thin strip. These graphs suggest that optimum uniformity of thin strip thickness in the width direction is achieved when w=60 mm and h=0.09 mm. This configuration improves the space factor by about 5%, as compared with a thin strip obtained by the use of a nozzle having a planar nozzle opening plane.

FIGS. 6 to 8 illustrate the thickness profile of a thin strip resulting from manufacture under the operating conditions listed in the individual graphs (center thickness: 25.7 μm, end thickness: 21 μm). The profile is approximated by a parabola. The nozzle gap distribution represents a distribution of the nozzle gap in the width direction which is dependent upon $g_o$, w and h, as shown in the graphs. The calculation shows a calculated thickness $t_{cal}$ determinable from the "basic" thickness t(x) and the "nozzle gap g(x)" at each of the positions on the assumption of n=0.25 in the following equation (5):

$$t_{cal} = t(x) \cdot (g(x)/g_o)^n \quad (5)$$

Because FIG. 6 shows an end basic thickness of 21 μm and a nozzle gap of 0.19 mm, the value of $t_{cal}$ is determinable as follows:

$$t_{cal} = 21 \cdot (0.19/0.10)^{0.25} \approx 24.7\ \mu\text{m}$$

Another means of changing the thickness profile shown in FIG. 4 into a substantially linear thickness profile under the conditions shown in Table 1 was also studied. This led to development of a third embodiment of the present invention. The relationship between the nozzle opening gap and the thickness (average in the width direction) of the thin strip was considered with reference to the report by Fiedler et al. in J. Mater. Sci. 19 (1984) 3229, and the presence of the following relation was clarified:

$$(\text{Thickness}) \propto (\text{slit-shaped opening gap})^p \ (p \approx 0.75)$$

where p is a constant dependent on the equipment configuration and operating conditions in the manufacture of a thin strip. Under the manufacturing conditions shown in Table 1, for example, a manufacturing experiment carried out by varying the values of nozzle gap revealed a value of $p \approx 0.75$.

Adjusting the gap of the slit shaped opening is an effective means of controlling strip thickness. Under the conditions for the manufacture of a thin strip shown in FIG. 4, for example, the thickness becomes uniform in the width direction by using a nozzle in which the slit-shaped opening gap is small at the longitudinal center and becomes larger toward both ends.

As described earlier, it is possible to approximate a thickness profile by a parabola. The thickness profile of the thin strip shown in FIG. 4, for example, can be expressed by:

$$t(x)=\{-4(t_{ce}-t_{ed})/L^2\cdot X^2+t_{ce} \quad (3)$$

where, t(x): thickness (mm) at a distance of x (mm) from the center in the width direction of the thin strip;

$t_{ce}$: thickness (μm) at the center in the width direction of the thin strip;

$t_{ed}$: thickness at the end in the width direction of the thin strip (μm);

L: width (mm) of the thin strip to be manufactured.

It is therefore possible to achieve a thickness of $t_{ce}$ of the thin strip over the entire width by imparting a longitudinal distribution to the gap of the slit-shaped opening, under the same conditions except for the slit-shaped opening gap, in accordance with:

$$a(x)=a_o\cdot(t(x)/t_{ce})^{(-1/p)}=a_o\cdot[[\{-4(t_{ce}-t_{ed})/L^2\}\cdot X^2+t_{ce}]/t_{ce}]4^{(-1/p)} \quad (2)$$

where, a(x): gap (mm) at a distance of x (mm) from the longitudinal center of the slit-shaped opening;

$a_o$: gap (mm) at the longitudinal center of the slit-shaped opening.

Accordingly, it is possible to manufacture a thin strip having a uniform thickness by using a nozzle in which the longitudinal distribution of the gap of the slit-shaped opening is in compliance with the foregoing equation (2).

For the thin strip shown in FIG. 4, for example, where L: 200, $t_{ce}$: 28 μm and $t_{ed}$: 24 μm, under the manufacturing conditions including $a_o$: 0.75 mm and p≈0.75, the thickness is substantially uniform with a value of 28 μm in the width direction when the longitudinal distribution of the opening gap is:

$$a(x)=0.75\ (\text{mm})\cdot[\{(-1/2500)\cdot X^2 28\}/28]^{(-1/0.75)} \quad (6)$$

When the gap of the slit-shaped opening conforms to a longitudinal distribution which satisfies the foregoing equation (2), it is desirable to completely satisfy the equation (2). However, it is practically possible, with a view to reducing the working cost, to slightly change the shape, for example, by using a combination of linearly worked members, to achieve a gap distribution substantially satisfying the equation (2). The longitudinal distribution of the gap suffices to comply with the equation (2) by curved working of either one or both sides which form the gap.

The following examples further illustrate embodiments of the disclosed invention:

EXAMPLE 1

An alloy, in an amount of 250 kg and having a chemical composition comprising 80 at. % Fe, 10 at. % B, 9 at. % Si and 1 at. % C was melted in a high-frequency induction melting furnace. The resultant molten metal was heated to 1,325° C. and was ejected under an ejecting pressure of 0.17 kgf/cm$^2$ from a nozzle having a slit-shaped opening gap of 0.75 mm. The molten metal was ejected onto the peripheral surface of a cooling roll rotating at 28 m/s, rapidly cooled and solidified. The result was a metal thin strip having a width of 200 mm.

When a thin strip was manufactured using a nozzle having a flat nozzle opening plane with a gap of 0.12 mm to the cooling roll, the resultant thin strip possessed a thickness profile illustrated in FIG. 4. The thin strip had a difference in thickness of about 4 μm (convex profile) between the center and the end of the thin strip.

Figure 9:
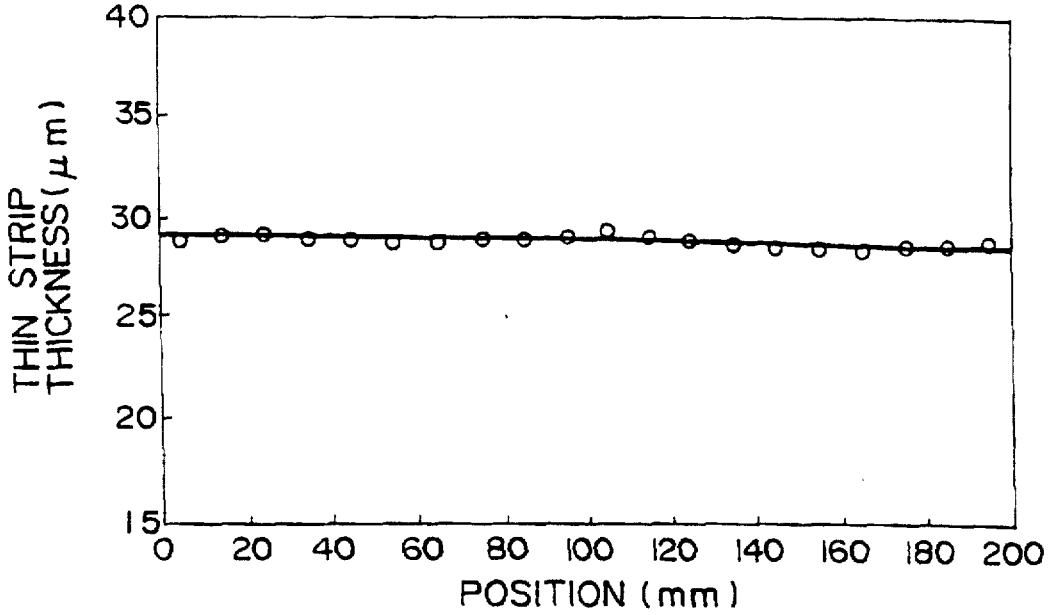
FIG. 9 is a graph illustrating the thickness distribution of a thin strip manufactured in accordance with a method of the present invention.

A thin strip was manufactured in the same manner as above, in accordance with the present invention, using a nozzle having a nozzle opening plane constructed with a parallel surface where w=100 mm and a tapered surface where h=0.12 mm (the nozzle gap was 0.12 mm at the center and 0.24 mm at both ends). The resultant thin strip exhibited substantially uniform thickness, measuring 28 μm, in the width direction, as shown in FIG. 9.

EXAMPLE 2

An alloy, in an amount of 250 kg, having a chemical composition comprising 80 at. % Fe, 10 at. % B, 9 at. % Si and 1 at. % C was melted in a high-frequency induction melting furnace. The resultant molten metal was heated to 1,325° C. and was ejected under an ejecting pressure of 0.14 kgf/cm$^2$ from a nozzle having a slit-shaped opening gap of 0.60 mm. The molten metal was ejected onto a peripheral surface of a cooling roll rotating at 26 m/s, and rapidly cooled for solidification. The resultant metal thin strip had a width of 150 mm.

Figure 10:
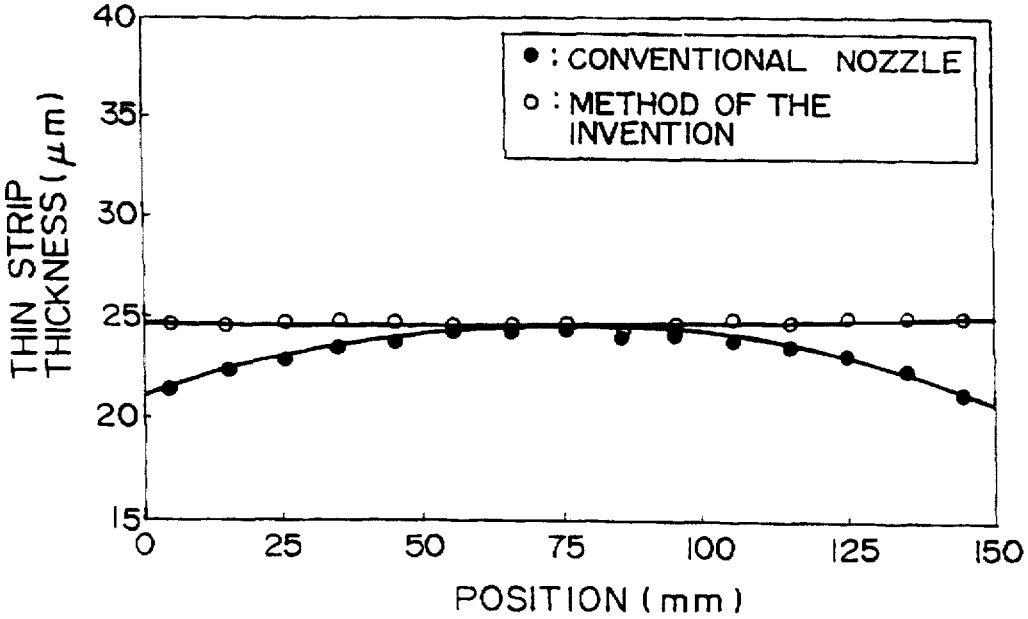
FIG. 10 is a graph comparing thickness distributions of thin strips manufactured by a method of the present invention and the conventional art.

When a thin strip was manufactured using a nozzle having a flat nozzle opening plane through a gap of 0.10 mm to the cooling roll, the resultant thin strip possessed a thickness profile as illustrated in FIG. 10. The thin strip had a difference in thickness of about 3 μm (convex profile) between the center and the end of the thin strip.

A thin strip was manufactured in the same manner as above, in accordance with the present invention, using a nozzle having a nozzle opening gap worked in compliance with the foregoing equation (1). The resultant thin strip exhibited a substantially uniform thickness, measuring 25 μm, in the width direction, as shown in FIG. 10.

EXAMPLE 3

An alloy, in an amount of 250 kg, having a chemical composition comprising 80 at. % Fe, 10 at. % B, 9 at. % Si and 1 at. % C, was melted in a high-frequency induction melting furnace. The resultant molten metal was heated to 1,325° C. and was ejected under an ejecting pressure of 0.17 kgf/cm$^2$ from a nozzle having a slit-shaped opening gap of 0.12 mm. The molten metal was ejected onto a peripheral surface of a cooling roll rotating at 28 m/s, and rapidly cooled for solidification. The resultant metal thin strip had a width of 200 mm.

When a thin strip was manufactured using a nozzle having a uniform slit-shaped opening gap of 0.75 mm, the resultant thin strip possessed a thickness profile as illustrated in FIG. 4. The thin strip had a difference in thickness of about 4 μm (convex profile) between the center and the end of the thin strip.

Figure 11:
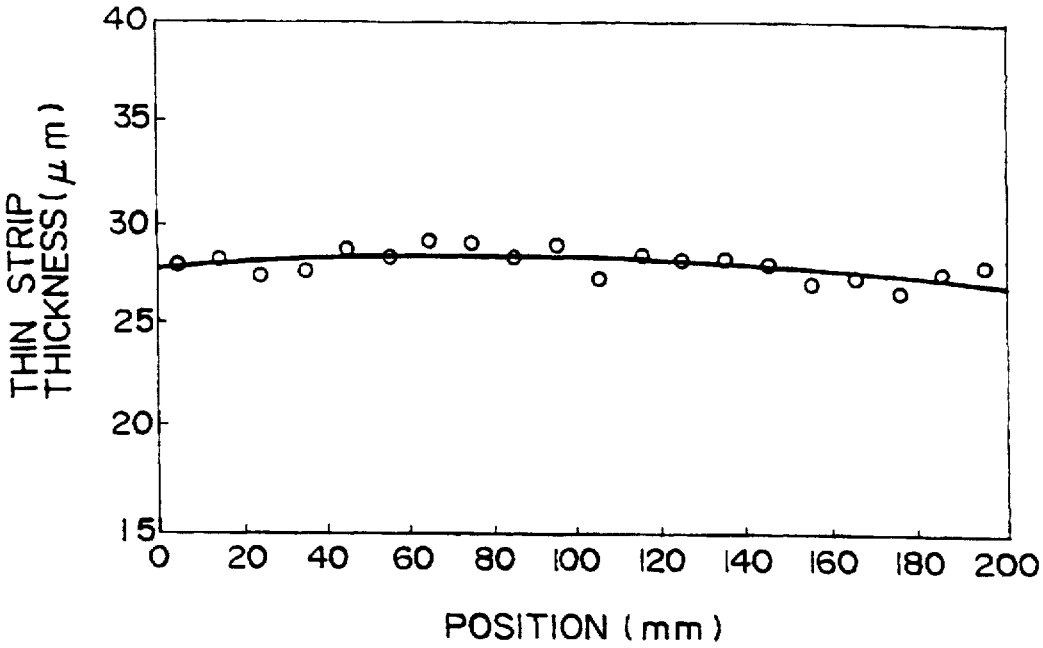
FIG. 11 is a graph illustrating the thickness distribution of a thin strip manufactured in accordance with a method of the present invention.

A thin strip was manufactured in the same manner as above, in accordance with the present invention, using a nozzle having a nozzle opening gap worked in compliance with the foregoing equation (2). The resultant thin strip exhibited a substantially uniform thickness, measuring 28 μm, in the width direction, as shown in FIG. 11.

EXAMPLE 4

An alloy, in an amount of 250 kg, having a chemical composition comprising 80 at. % Fe, 10 at. % B, 9 at. % Si and 1 at. % C was melted in a high-frequency induction melting furnace. The resultant molten metal was heated to 1,325° C. and was ejected under an ejecting pressure of 0.14 kgf/cm$^2$ from a nozzle having a slit-shaped opening gap of 0.10 mm. The molten metal was ejected onto a peripheral surface of a cooling roll rotating at 26 m/s, and rapidly cooled for solidification. The resultant metal thin strip had a width of 150 mm.

Figure 12:
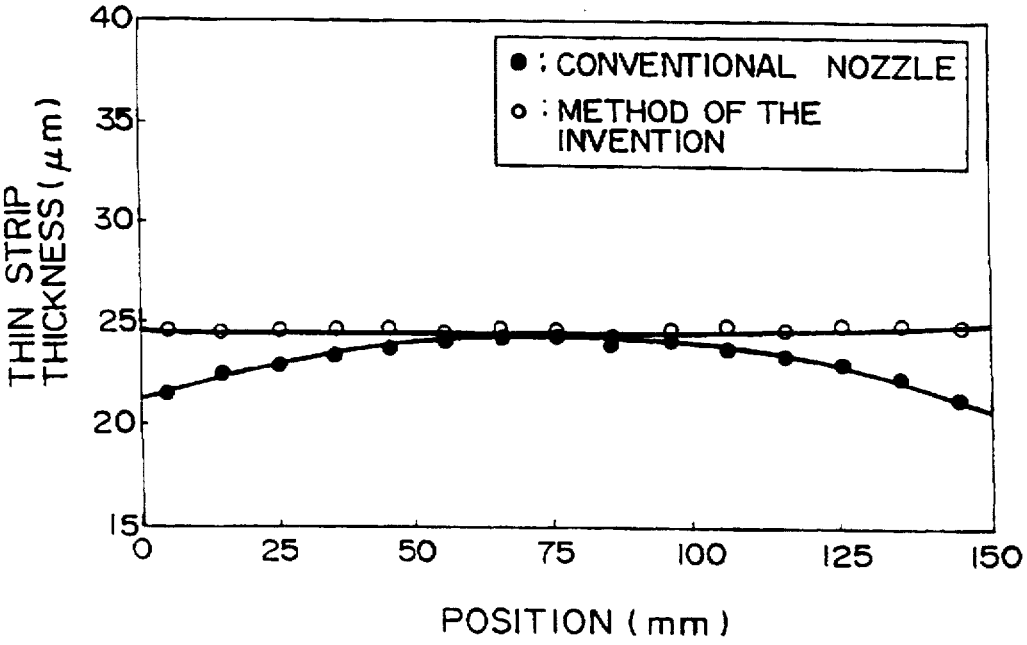
FIG. 12 is another graph comparing thickness distributions of thin strips manufactured by methods of the present invention and the conventional art.

When a thin strip was manufactured using a nozzle having a uniform slit-shaped opening gap of 0.60 mm, the resultant thin strip possessed a thickness profile as illustrated in FIG. 12. The thin strip had a difference in thickness of about 3 μm (convex profile) between the center and the end of the thin strip.

A thin strip was manufactured in the same manner as above, in accordance with the present invention, using a nozzle having a nozzle opening gap worked in compliance with the foregoing equation (2). The resultant thin strip exhibited a substantially uniform thickness, measuring 25 μm, in the width direction, as shown in FIG. 12.

According to the present invention, the opening shape of a nozzle is optimized, thus permitting easy manufacture of a wide thin strip having a uniform thickness in the width direction.

What is claimed is:

1. A method of manufacturing a wide metal thin strip from a molten metal, comprising:

ejecting said molten metal from a slit-shaped opening of a nozzle toward a surface of a cooling roll, said cooling roll rotating at high speed; and rapidly cooling said molten metal causing solidification of said metal, wherein upon ejection of said molten metal, opening planes of said nozzle are longitudinally convex, and a gap between said nozzle and said cooling roll widens toward the edges of said nozzle.

2. The method according to claim 1, wherein the gap between said nozzle and said cooling roll is narrowest at the center of said nozzle and widens toward the edges of said nozzle.

3. The method according to claim 1, wherein said opening planes further comprise:

a center opening plane forming a surface parallel to said cooling roll;

two tapered opening planes, each tapered opening plane located at an edge of said center opening plane and extending away from said cooling roll.

4. The method according to claim 1, wherein the gap between said nozzle opening planes and said cooling roll is such that a longitudinal position is substantially expressed by the following equation (1):

$$g(x)=g_o\cdot[[\{-4(t_{ce}-t_{ed})/L^2\}\cdot x^2+t_{ce}]t_{ce}]^{(-1/n)} \quad (1)$$

where, g(x): the gap (mm) between the nozzle opening plane and the cooling roll at a distance of x (mm) from the longitudinal center of the nozzle opening plane;

$g_o$: the gap (mm) between the nozzle opening plane and the cooling roll at the longitudinal center of the nozzle opening plane;

$t_{ce}$: the thickness (μm) at the width center of a metal thin strip manufactured with a constant longitudinal gap $g_o$ between the nozzle opening plane and the cooling roll;

$t_{ed}$: the thickness (μm) at the width ends of a metal thin strip manufactured with a constant longitudinal gap $g_o$ between the nozzle opening plane and the cooling roll;

L: the width (mm) of the metal thin strip to be manufactured; and n: an experimentally derived constant representing the degree of effect of the nozzle gap on the thickness: (Thickness)$\propto$(nozzle gap)$^n$.

5. The method according to claim 1, further comprising collecting said wide metal thin strip after said solidification.

6. An apparatus for manufacturing a wide metal thin strip, comprising:

a nozzle having a slit-shaped opening defining a plurality of opening planes; and a cooling roll which rotates at high speeds;

wherein said opening planes of said nozzle are longitudinally convex and a gap between said opening planes and said cooling roll widens toward the edges of said nozzle.

7. The apparatus according to claim 6, wherein said gap between said opening planes and said cooling roll is narrowest at the center of said nozzle and widens toward the edges of said nozzle.

8. The apparatus according to claim 6, wherein said nozzle further comprises:

a center opening plane forming a surface parallel to said cooling roll; and two tapered opening planes, each tapered opening plane located at an edge of said center opening plane and extending away from said cooling roll.

9. An apparatus for manufacturing a wide metal thin strip from a molten metal, comprising:

means for ejecting said molten metal from a slit-shaped opening of a nozzle toward a surface of a cooling roll, said cooling roll rotating at high speed; and rapidly cooling said molten metal causing solidification of said metal, wherein upon ejection of said molten metal, opening planes of said nozzle are longitudinally convex, and a gap between said nozzle and said cooling roll widens toward the edges of said nozzle; and means for collecting said wide metal thin strip after said solidification.

* * * * *

UNITED STATES PATENT AND TRADEMARK OFFICE

CERTIFICATE OF CORRECTION

PATENT NO. : 5,758,715

DATED : June 2, 1998

INVENTOR(S) : Katsumi KUROKAWA; Shun SUHARA; Toshitane MATSUKAWA; Haruhiko ISHIZUKA; and Toru SATO It is certified that error appears in the above-identified patent and that said Letters Patent is hereby corrected as shown below:

Column 3, line 16, change "$g(x)=g_o\cdot[[\{-4(t_{ce}-t_{ed})/L^2]\cdot x^2+t_{ce}]+t_{ce}\}^{(-1/n)}$" to --$g(x)=g_o\cdot[[\{-4(t_{ce}-t_{ed})/L^2\}\cdot x^2+t_{ce}]/t_{ce}]^{(-1/n)}$--.

Column 3, line 47, change "$a(x)=a_o\cdot[[\{-4(t_{ce}-t_{ed})/L_2\}\cdot X^2+t_{ce}]/t_{ce}]^{(-1/p)}$" to --$a(x)=a_o\cdot[[\{-4(t_{ce}-t_{ed})/L^2\}\cdot x^2+t_{ce}]/t_{ce}]^{(-1/p)}$--.

Column 4, line 55, change "gas" to --gap--.

Column 7, line 10, change "$t(x)=\{-4(t_{ce}-t_{ed})/L^2\cdot X^2+t_{ce}$" to --$t(x)=\{-4(t_{ce}-t_{ed})/L^2\}\cdot x^2+t_{ce}$--;

line 27, change "$a(x)=a_o\cdot(t(x)/t_{ce})^{(-1/p)}= a_o\cdot[[\{-4(t_{ce}-t_{ed})/L^2\}\cdot X^2+t_{ce}]/t_{ce}]4^{(-1/p)}$" to --$a(x)=a_o\cdot(t(x)/t_{ce})^{(-1/p)}= a_o\cdot[[\{-4(t_{ce}-t_{ed})/L^2\}\cdot x^2+t_{ce}]/t_{ce}]^{(-1/p)}$--;

line 39, change "200," to --200mm--; and line 46, change "$a(x)=0.75(mm)\cdot[\{(-1/2500)\cdot X^2 28\}/28]^{(-1/0.75)}$" to --$a(x)=0.75(mm)\cdot[\{(-1/2500)\cdot x^2+28\}/28]^{(-1/0.75)}$--.

Column 9, line 58, change "$g(x)=g_o\cdot[[\{-4(t_{ce}-t_{ed})/L^2\}\cdot x^2+t_{ce}]t_{ce}]^{(-1/n)}$" to --$g(x)=g_o\cdot[[\{-4(t_{ce}-t_{ed})/L^2\}\cdot x^2+t_{ce}]/t_{ce}]^{(-1/n)}$--.

Signed and Sealed this

Thirtieth Day of March, 1999

*Attest:*

Q. TODD DICKINSON

*Attesting Officer*

*Acting Commissioner of Patents and Trademarks*